US009816295B1

(12) United States Patent
Taylor, III

(10) Patent No.: US 9,816,295 B1
(45) Date of Patent: Nov. 14, 2017

(54) EMERGENCY ENTRY CONTROL SYSTEM

(71) Applicant: John Taylor, III, Prince Frederick, MD (US)

(72) Inventor: John Taylor, III, Prince Frederick, MD (US)

( * ) Notice: Subject to any disclaimer, the term of this patent is extended or adjusted under 35 U.S.C. 154(b) by 210 days.

(21) Appl. No.: 14/601,211

(22) Filed: Jan. 20, 2015

Related U.S. Application Data

(60) Provisional application No. 61/928,992, filed on Jan. 17, 2014.

(51) Int. Cl.

| | |
|---|---|
| ***E05B 65/10*** | (2006.01) |
| ***E05C 7/04*** | (2006.01) |
| ***E05C 19/00*** | (2006.01) |
| ***E05C 19/18*** | (2006.01) |
| ***E05C 17/58*** | (2006.01) |

(52) U.S. Cl.
CPC ..... *E05B 65/10* (2013.01); *E05B 65/108* (2013.01); *E05B 65/1086* (2013.01); *E05C 7/045* (2013.01); *E05C 17/58* (2013.01); *E05C 19/003* (2013.01); *E05C 19/182* (2013.01); *E05C 19/188* (2013.01)

(58) Field of Classification Search
CPC ..... Y10T 292/34; Y10T 292/228; Y10T 292/376; Y10T 70/5566; E05C 19/18; E05C 19/184; E05B 65/0894; Y10S 292/15
USPC ..... 292/92
See application file for complete search history.

(56) References Cited

U.S. PATENT DOCUMENTS

| | | | | |
|---|---|---|---|---|
| 4,198,088 A * | 4/1980 | Tochihara | E05C 19/18 | 292/288 |
| 4,585,259 A * | 4/1986 | Vidas | E05C 17/54 | 16/82 |
| 4,657,293 A * | 4/1987 | Bell | E05C 19/182 | 292/244 |
| 6,604,764 B2 * | 8/2003 | Zemzik | E05C 19/188 | 292/288 |

* cited by examiner

*Primary Examiner* — Mark Williams
(74) *Attorney, Agent, or Firm* — Leslie A. Thompson; Leslie A. Thompson & Associates

(57) ABSTRACT

An emergency entry control system which is particularly adaptable for use with double panic doors typically found in schools, movie theaters, and other public facilities. The system includes a base, connecting bracket, and engagement means designed to be removably secured to the top latching mechanism and/or bottom latching mechanism of a conventional double panic door configuration to prevent double panic doors without a center bar from being opened from the outside. The system is rotated manually to permit the panic doors to operate normally. The system can also be modified with wireless and audio technology to effectuate audible and visual notification and facilitate location and communication during emergency situations like an unauthorized attempt at entry or removal of the system.

11 Claims, 6 Drawing Sheets

EMERGENCY ENTRY CONTROL SYSTEM

REFERENCE TO RELATED APPLICATION

This application incorporates by reference Provisional Patent Application No. 61/928,992 submitted on behalf of Applicant on Jan. 17, 2014.

FIELD OF THE INVENTION

The present invention relates generally to safety devices and more particularly to an improved emergency entry control system which is particularly adaptable for use with double panic doors typically found in schools, movie theaters, and other public facilities.

BACKGROUND OF INVENTION

Random mass shootings have long accompanied the proliferation of firearms around the world. In 2012, Americans witnessed a rash of random fatal shootings at schools, theaters, and workplaces alike. There were sixteen (16) random mass shootings last year alone in the United States that tragically and needlessly claimed the lives of 88 people. None more upsetting and heart wrenching than the 26 lives lost, which included 20 children, at the hands of a random shooter at Sandy Hook Elementary School in Newtown, Conn. on Dec. 14, 2012. The safety of the occupants of public and private facilities is paramount and innovation is needed to secure said facilities at every level.

In many of the aforementioned buildings, double panic doors are commonly used to quickly accommodate the ingress and egress of the general public in high volumes. The double panic doors are configured to open by applying force to panic bars or strike bars, which are generally disposed midway on the inside between the top and bottom of the respective doors, thus causing the strike bars to urge inwardly and release the locking means for the door-latch system. These double panic doors can also be locked and unlocked from the outside using a variety of systems including, but not limited to, biometric readers, conventional keys, and card readers. FIG. 5 shows a conventional key lock and door handle arrangement on the outside surface of the double panic door configuration.

Double panic doors can be a liability in certain situations as intruders have learned how to circumvent or overwhelm these door configurations. Schools and other public/private institutions have seen an increase of criminal acts that could be abated or mitigated. There exists a need to improve the security of double panic doors to control entry and operation of the doors while affording police and authorities more time to respond to emergency situations where every second could be the difference between life and death.

It is to be understood that both the foregoing general description and the following detailed description are exemplary and explanatory only and are not restrictive of the invention as described. The accompanying images, which are incorporated in and constitute part of the specification, illustrate various embodiments of the invention and together with the general description, serve to explain the principles of the invention.

BRIEF DESCRIPTION OF THE PREFERRED EMBODIMENTS

This invention relates to safety devices and more particularly to an improved emergency entry control system which is particularly adaptable for use with double panic doors typically found in schools, movie theaters, and other public facilities. The emergency entry control system 10 of the present invention is depicted generally in FIGS. 1-4.

Figure 5:
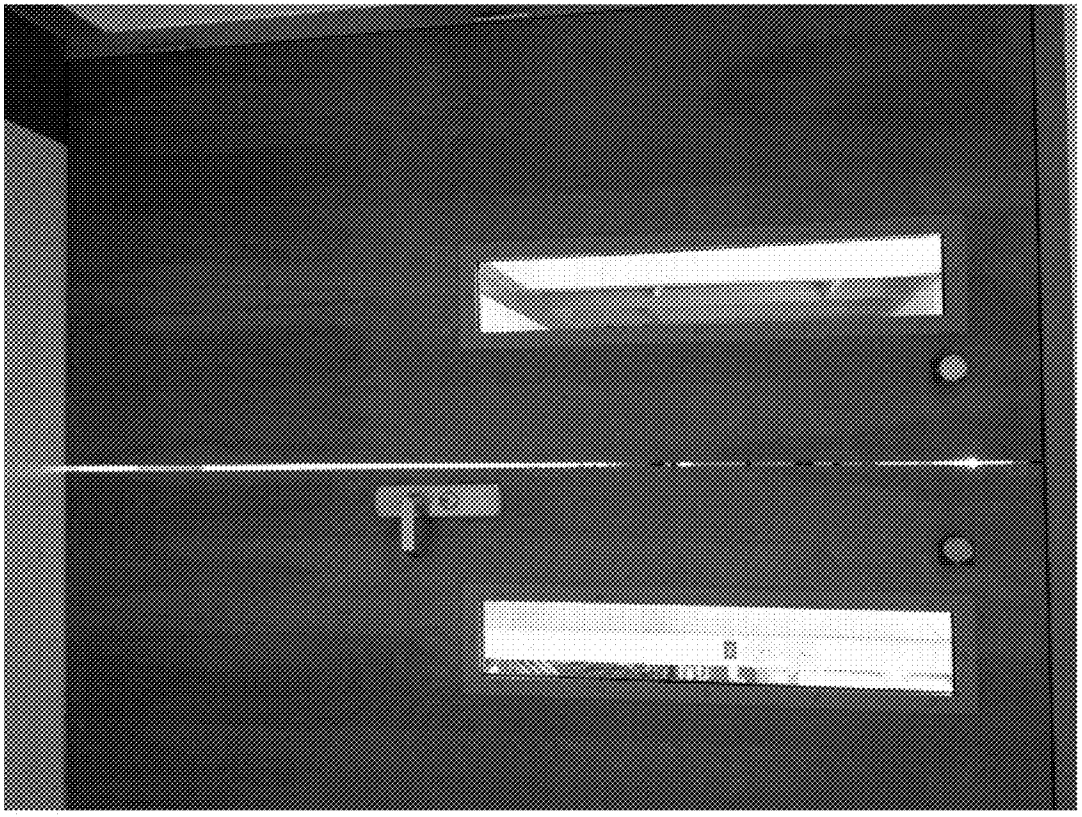
FIG. 5 is a digital image of perspective view of the inside of a conventional double panic door configuration in a closed position.
Figure 6:
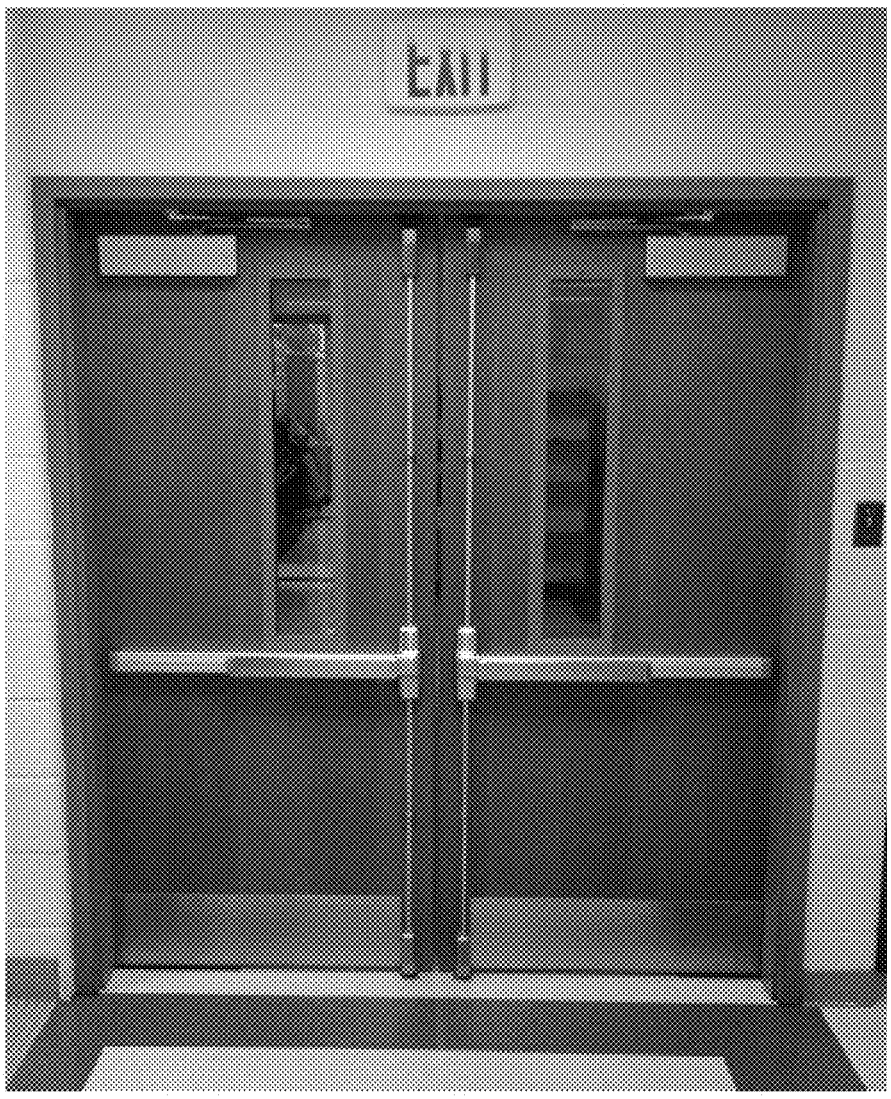
FIG. 6 is a digital image of a perspective view of the outside of a conventional double panic door configuration in a closed position.

Referring to FIGS. 5-6, the inside surface of a conventional double panic door configuration 70 has a baseplate covered by a housing and operatively coupled to the latch rod mechanism. A push bar or strike bar 71 is oriented with the baseplate so that it can move between a first outward position and a second inward position upon the application of force. The strike bar may 71 extend the entire length of the baseplate or may only extend a portion of the length of the baseplate. An end cap 72 may be used to discourage any lateral movement of the strike bar.

The locking mechanism 75 typically includes a vertical housing mounted flush to the door and a horizontal housing extending thusly from the vertical housing. The horizontal housing encloses a primary link carriage that retracts in response to the movement of the strike bar. The primary link carriage is usually coupled to both the latch bolt and a secondary bolt. The latch bolt is functionally coupled to the horizontal housing by conventional means.

As seen in FIG. 5, the locking mechanism is used to actuate vertical rods. This style of panic door system 70 is used commonly in conjunction with double doors having a strike 40 in the header and a strike in the floor 45. The respective strike bars are mounted to the door along and coupled with a dogging mechanism. These elements operate as described above. A center case mechanism 73 is used to translate the motion of the strike bar 71 to a pair of vertical rods. A first vertical 31 rod operates the latching mechanism 25. Latching mechanisms 25, 26 are well known and many configurations exist. The housings for the latching mechanisms 25, 26 are disposed at the distal end of each rod 31,36. The respective and corresponding housings 25,26 completely encase the mechanical couplings that engage or retract the latch or peg locking means housed therein. The latch 30 upwardly protrudes from an aperture in the top of the housing 25 and is fittingly received in a recessed and reinforced area 40 in the corresponding door jamb or upper sidewall. The peg 30 downwardly protrudes from an aperture in the bottom of the housing 26 and is fittingly received in a recessed and reinforced area 45 in the corresponding floor area.

When opening the door 70, as the first vertical rod 31 moves upward, the latching mechanism 25 is urged to retract the latch 30 from the recessed area 40 in response to the upward movement of said rod 31. The second vertical rod 36 is arranged to orient a peg 30 and similarly retracts the peg 30 when the second rod 36 is moves downward. The functional coupling of the vertical rods 31,36 and latching mechanisms when the strike bar 71 is inwardly urged by force translates to the retraction of the latch 29 and the peg 30, thus permitting the double panic doors 70 to be opened. Preventing the engagement of the latch 29 and peg 30 in locked positions and maintaining the double panic doors 70 in an unlocked orientation is accomplished with the present invention.

Figure 1:
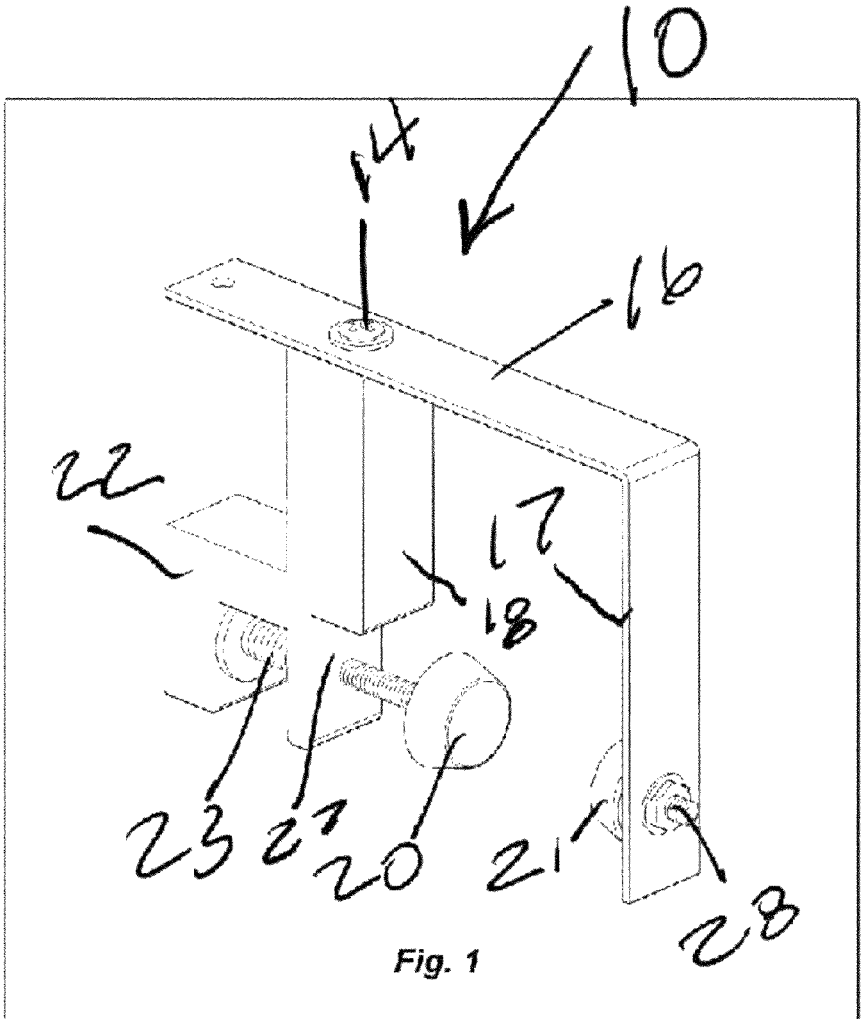
FIG. 1 is a perspective view of the emergency entry control system of the present invention.
Figure 2:
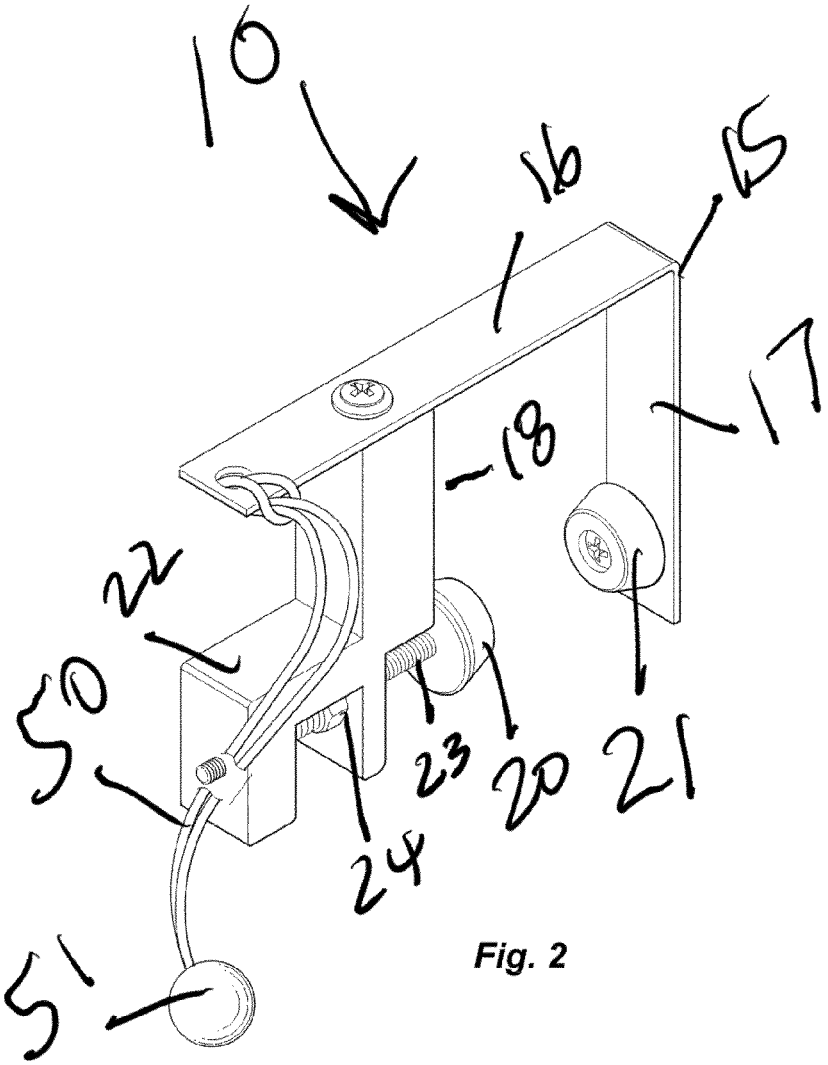
FIG. 2 is a perspective view of the emergency entry control system of the present invention.
Figure 3:
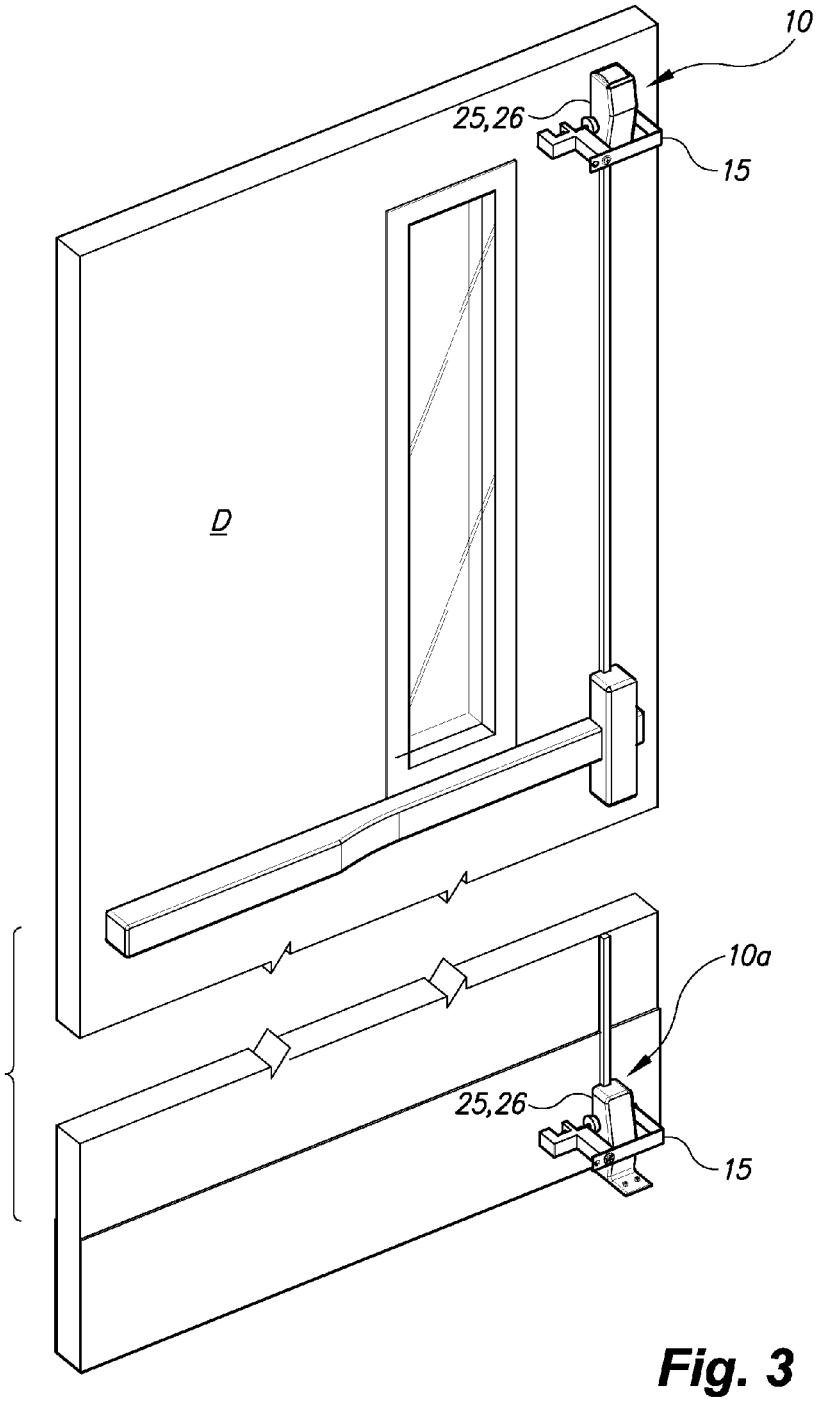
FIG. 3 is a perspective view of the emergency entry control system of the present invention as installed on a conventional double door.

As seen in FIGS. 1-3, the emergency entry control system 10 comprises two components when assembled have a generally U-shaped configuration of appreciable thickness defined by two vertically oriented sidewalls 17, 18 fixedly or adjustably connected by a horizontally oriented arm 16 of an L-shaped bracket 15 to facilitate the releasable and adjustable engagement of the device 10 to the sidewalls of the housings of the respective latching mechanisms 25, 26.

In the described embodiment, the bracket 15 has an L-shaped configuration with a depending arm 16 and sidewall 17 where the horizontally oriented arm 16 depends from the sidewall 17 and fixedly or releasably couples to the top of the opposing sidewall 18. In the embodiment shown, the depending arm 16 and sidewall 17 are a unitary construction, but the invention does envision an alternative embodiment where the depending arm 16 and sidewall 17 are separate components that are releasably attached to an L-shaped bracket to facilitate adjusting the sidewall 17 horizontally or vertically to ensure proper engagement with a latching mechanism 25,26. The separate components 16,17 are coupled to the L-bracket using conventional mechanical fasteners. Any conventional fastening system suitable for the intended purpose can be employed. In this alternative embodiment, the separate components 16,17 feature a plurality of spaced apart threaded apertures to accommodate adjusting the dimensions of the separate construction.

As best seen in FIG. 1, the generally rectangular opposing sidewall 18 depends from the arm 16 and terminates in a distal end defined by recessed area in the inner wall that accommodates the distal end of a first padded engagement head 20 and a perpendicularly protruding portion 22 that houses a spring-biased coupling of the rod of the first padded engagement head.

The first padded engagement head 20 consists of a rod 23 that is disposed through a corresponding bore 24 in the sidewall 18 and perpendicularly protruding portion 22. The perpendicularly protruding portion 22 houses a mechanical fastener coupling that receives the rod 23 and permits the piston-like movement of the rod 23 through the housing 22 using a rotating threaded system or other means of biased movement of the rod 23 in response to force or manual manipulation. In the alternative, the same movement of the rod may be accomplished where the perpendicularly protruding portion 22 houses a spring-biased coupling that receives the rod 23 and permits the piston-like movement of the rod 23 through the housing 22 as force is applied to the head 20 of the rod 23.

The head 20 of the rod 23 features a padded enclosure designed to frictionally engage the exterior of the housing of the latching mechanism 25,26 and permit the rotation of the head 20 without damaging or scratching the housing of the latching mechanism 25,26 while maintaining frictional engagement. The padded head 20 of the rod 23 nestles in the inner recessed area 27 of sidewall 18 when the head is inwardly urged and the spring-biased coupling system is compressed.

The sidewall 18 depends from the opposing end of the arm 16 of the bracket 15. In the preferred embodiment, the bracket 15 is a unitary construction, but the invention does envision an embodiment where the arm 16 and sidewall 17 are separate components and the arm 16 is adjustably attached to the proximate end of the sidewall 17 using a connecting L-bracket. Any conventional fastening system suitable for the intended purpose can be employed.

As best seen in FIG. 2, the generally planar sidewall 17 of bracket 15 depends from the arm 16 and terminates in a distal end defined by a second padded engagement head 21 disposed flush on the inner side of sidewall 17. The head of a cylindrical mechanical fastener 28 features a padded enclosure 21 like the first padded engagement head 20 designed to frictionally engage the exterior of the housing of the latching mechanism 25,26 and permit the rotation of the head 21 without damaging or scratching the housing while maintaining frictional engagement. The bottom of the padded enclosure 21 sits flush with the interior of the sidewall 17. The remainder of the mechanical fastening system 28 is perpendicularly disposed through a corresponding bore (not shown) in the sidewall 17 and fixedly coupled thereto using corresponding female mechanical fasteners 28. The second padded engagement head 21 is static in the preferred embodiment. Alternative embodiments teach design of the second padded engagement head 21 to travel in a piston-like motion to frictionally engage the exterior of the latching mechanism 25,26.

The padded enclosures 20, 21 may be constructed from firm rubber or synthetic materials with sufficiently rigid qualities that can be engaged and rotated on a surface without scratching said surface or losing frictional engagement therewith.

In the adjustable embodiment where the arm 16 and sidewall 17 are separate components, the opposing end of the arm 16 can feature a plurality of serially spaced apart threaded bores. A first arm of an L-bracket abuts the bottom surface of the opposing end of the arm 16 and has a corresponding bore at the end of the first arm. In an effort to accommodate universal application of the present invention, the position of abutment of the L-bracket with the arm 16 will be determined by the dimensions of the housing of the latching mechanism 25,26. Once optimal orientation is established to ensure snug engagement, a mechanical fastener is introduced through the bore in the first arm of the L-bracket and a corresponding bore in the connecting arm 16 and subsequently coupled using corresponding female mechanical fasteners.

In that same alternative embodiment, the proximate end of the sidewall 17 features a plurality of serially spaced apart bores. The second arm of the L-bracket abuts the outer surface of the proximate end of the sidewall 17 and has a corresponding bore at the end of the second arm. A mechanical fastener is introduced through the bore in the second arm and a corresponding bore in the sidewall 17 and subsequently coupled using conventional means.

The arm 16 is a generally planar construction and fixedly coupled on a first end to the sidewall 18 and adjustably coupled on the opposing end to sidewall 17.

As previously mentioned, it is within the scope of the present invention for the device to be a unitary construction or a multiple-component construction. The base components can be formed from a single mold or joined via industrial welding means. The base components are ideally constructed from metal or sufficiently rigid materials.

Figure 4:
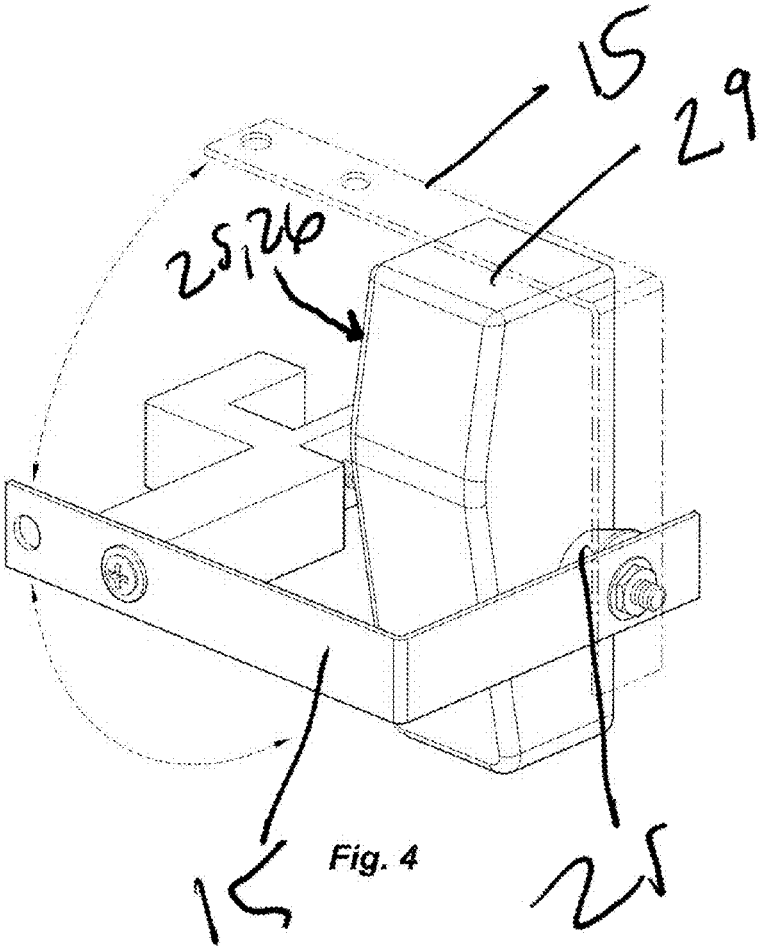
FIG. 4 is a perspective view of the emergency entry control system of the present invention as disengaged from latching mechanism on a conventional double door.

As seen in FIGS. 3-4, the system 10 described herein is easily and universally applied to the housings of the latching mechanisms 25,26 in a matter of seconds. With respect to the upper latch 29, the system is disposed such that the exterior of the latching mechanism 25 is received within the sidewalls of the U-shaped device 10 as the first padded engagement head 20, which is rotatingly-biased, is inwardly urged. The first padded engagement head 20 is snugly engaged by manually rotating the head (or releasing said head 20 and the spring urges said head) to the frictionally engage the exterior of the latching mechanism 25. The second padded engagement head 21 is concurrently frictionally engaged to the opposing of the latching mechanism such that the user may now remove his or her hand and the system 10 will remain in said orientation.

As seen in FIGS. 3-4, in the event the user wishes to orient the system 10 to prevent the latch 29 from being urged into the corresponding recessed and reinforced area 40 of the upper door jamb, the user manually manipulates the system 10 by bringing the arm 16 to rest flush atop the aperture from which the latch 29 vertically protrudes. The padded engagement heads 20,21 facilitate the rotation of the system 10 without the loss of frictional engagement or damage to the housing 25 from repeated rotation or frequent installation/removal of the system. The latch is then prevented from exiting the housing by the connecting baseplate. Rotation of the system 10 is facilitated by the tethering a flexible elongate 50 to the distal end of the arm 16. The flexible elongate 50 can feature a ball on the opposing end to prevent the user's hand from slipping off of the flexible elongate 50, thus ensuring a proper grip in emergency situations.

As seen in FIGS. 3-4, in the event the user wishes to orient the system 10 to prevent the peg 30 from being urged into the corresponding recessed and reinforced area 45 of the floor, the user manually manipulates the system bringing the connecting arm 16 to rest flush with the bottom of the aperture from which the peg 30 downwardly protrudes. The padded engagement heads 20,21 facilitate the rotation of the system without the loss of frictional engagement or damage to the housing 26 from repeated rotation or frequent installation/removal of the system 10. The peg 30 is then prevented from exiting the housing 26 by the arm 16.

The order of rotation of the respective devices of the system to prevent the locking of the door is selectively determined by the user. The present system teaches placement of the U-shaped devices 10 on the upper and lower latching mechanisms 25,26. However, it is within scope of the invention to selectively employ a single device 10 if the latching mechanisms 25,26 are cooperatively coupled requiring dual deployment of the latch 29 and peg 30 barring mutually exclusive operation of either the latch 29 or peg 30.

The components of the system 10 can be easily removed from the latching mechanisms 25,26 by inwardly urging the first padded engagement head 20 and moving the U-shaped devices 10 away from the respective latching mechanisms 25,26 or simply applying sufficient force and removing the devices 10.

An alternative embodiment of the emergency entry control system 10 teaches the inclusion of a motion/vibration sensor in sidewall 18. When the system 10 is installed, the internal motion/vibration sensor is ideally calibrated to detect the application of force or vibrations associated with an authorized attempt to remove the components of the system 10. The sensor is electronically coupled to an internal digital controller that activates a visual and/or audible alarm also disposed in the sidewall 18. Once the system 10 is activated, the default setting activates the alarm immediately upon detection of force, thus eliminating the need for a user to remember to adjust the settings in an emergency situation.

For older buildings without a smart alarm system, another embodiment of the emergency entry control system 10 teaches the inclusion of a wireless transceiver/transponder/global positioning system (GPS) integrally housed in the sidewall 18 or protruding section 22. When the system 10 is installed, the internal motion/vibration sensor is ideally calibrated to detect conditions associated with an unauthorized removal of the system 10. The sensor is electronically coupled to an internal digital controller that activates a transceiver/transponder that communicates wirelessly to alert the police and building officials of an authorized removal and possible emergency situation. Once the system 10 is activated, the digital controller electronically communicates with a smart external interface on the outer wall of the base that permits the user to selectively input a disarm code before the wireless alert is sent. The default setting alerts the authorities immediately upon removal, thus eliminating the need for a user to remember to adjust the settings in an emergency situation. The GPS allows police and school officials to quickly determine the location of the removed system 10 and direct building inhabitants away from the area in question. Alternatively, this embodiment can be adapted with BLUETOOTH® technology to facilitate "pairing" or wirelessly coupling the device to designated multimedia devices for shortened response times and enhanced functionality.

In the unlikely event the emergency protective system 10 is compromised and dislodged or removed by an intruder, another embodiment of the invention teaches the inclusion of a replaceable or refillable integral canister of tear gas stored in the central component. When the device 10 is installed, the internal motion/vibration sensor is ideally calibrated to detect unauthorized removal of the system 10 without entry of the disarm code. The internal sensor is electronically coupled to an internal digital controller that effectuates the puncturing of the canister and the immediate and rapid dispersal of tear gas (or non-toxic smoke) through a port in the upper surface of the central component to discombobulate the intruder and/or obstruct the line of sight of an intruder, thus discouraging handling of the system components 10 and delayed execution of a desire to harm the building inhabitants. Once the system 10 is activated, the internal digital controller interprets data from the internal sensor to determine when the device 10 has been removed.

The aforementioned embodiments are not mutually exclusive and can all be fully integrated into the emergency entry control system 10. It is within the scope of the invention, for instance, to permit a police dispatcher to issue verbal warnings to abort unauthorized entry attempts through an internal speaker of the integral audible alarm once the transceiver/transponder wirelessly communicates an alert. Integrated BLUETOOTH® technology will allow a user to remotely program the internal digital controller without the external smart user interface or terminate the alarm.

It is also with the scope of emergency entry control system 10 of this invention to adapt the padded engagement heads 20,21 to facilitate the motorized rotation of the system components 15,18,22 via a wireless remote control system that electronically communicates with the internal digital program controller once installed. An electronically-controlled rotating device(s) 10 that can easily be installed by a user is disclosed. The motorized device includes an internal power source, a motor, and a communication system to allow for remote control of the motorized device 10. One or more motorized devices 10 can be controlled individually or as a group. In one embodiment, the motorized devices 10 are used in connection with a zoned or non-zoned security system to reduce monitoring requirements as necessary. In another embodiment, the motorized device 10 is configured to have a size and form that conforms to work in conjunction with a standard latching mechanism 25,26. In one embodiment, a group controller is configured to interpret and transmit sensory information from/to the motorized device 10. In yet another embodiment, the group controller communicates with a central monitoring system that coordinates operation of one or more motorized devices 10. The internal power source of the motorized device 10 is recharged by a solar cell, rechargeable battery, disposable battery, or integrated power supply with the power system of the building.

In the motorized embodiment of the emergency entry control system 10, a self-contained motorized device 10 features a mechanical coupling of a motor to the second padded engagement head 21 via a conventional motor mount and includes an internal controller. The internal controller provides control for communications, power management, and other control functions. The motor features a gearbox that is electronically coupled to the controller. In one embodiment, the motor includes an internal rotation gauge and control switches to limit the rotation of the device and establish the stop points of the motor. The padded engagement heads 20,21 remain fixed once attached to the latching mechanism 25,26 with internal rotation of the motorized rod causing the device 10 to be pivotally raised or lowered without movement of the padded engagement heads 20,21.

In the motorized embodiment of the emergency entry control system 10, an internal wireless signal/radio frequency (RF) transceiver is integral to the internal controller. An InfraRed (IR) and/or light sensor receiver is housed in the internal controller. RFID tags can also be integrated therein. An IR receiver can be used to provide operational inputs to the controller. In embodiments where radio frequency control is used instead of IR control, IR transceiver is omitted. In either embodiment, the IR or RF receiver is configured as a transceiver to allow two-way IR or RF communications between the motorized device and a controller. BLUETOOTH® communication systems are similarly integrated to control the raising and lowering of the motorized device 10.

In the motorized embodiment of the emergency entry control system 10, a capacitor can be coupled to the controller, thus allowing the controller to extend the life of power source by consuming power relatively slowly, and/or at relatively low voltage from the first power source to charge the capacitor, which can also selectively and internally power the controller, the transceiver, and/or the motor. As mentioned, a solar cell can be electronically coupled to the controller and power the device component.

Thus, it may be seen that the emergency entry control system 10 of the present invention has important advantages over the known prior art structures in that such a safety device may be rapidly and easily installed upon double panic door configurations as to reactively control operation of the panic door upon which the system components are installed. The device is removably secured upon the door latching assemblies in a manner not conducive to casual removal, such as in a locked enclosure attached to or near the door in question.

The alternative embodiments of the emergency entry control system 10 feature an internal battery source housed in the central component. The battery source may feature disposable batteries or rechargeable batteries. Disposable batteries will be selectively introduced or removed via an access door to the battery compartment in the first or second sidewall. The rechargeable battery version of the device will feature a tethered arrangement with a conventional electrical outlet to replenish internal battery power. Once the emergency situation has been abated and calm has been restored, the user can remove the installed system components and store them in a readily accessible place and/or recharge/replenish expended components of the device before storage.

Obviously, many modifications and variations of the present invention are possible in light of the above teachings. It will be appreciated by those skilled in the art that the device 10 can be constructed from any suitable material and is adaptable to many colors, prints, and themes. In the preferred embodiment, the device 10 is rigid to promote durability and enhance the protective qualities of the instant invention. The device 10 can alternatively be adapted with a flexible or semi-rigid housing. Moreover, disposable and short-term use embodiments of the device 10 are within the scope of the present invention.

The present invention can be used in conjunction with the emergency entry prevention system described in patent application Ser. No. 14/214,520 and incorporated by reference herein. The two systems can be selectively used in conjunction with the other in the event of the failure or the inability to install or remove one system over the other. The systems can be sold together or separately and be stored in the same manner.

While the present invention has been explained by a detailed description of a preferred embodiment, it is understood that various modifications and substitutions can be made with respect to the preferred embodiment or embodiment described herein within the scope of the present invention and its equivalents. It will be apparent; however, that variations and modifications may be made by those skilled in the art to the disclosed embodiments of the invention, with the attainment of some or all of its advantages and without departing from the spirit and scope of the present invention.

The invention claimed is:

1. An emergency entry control system for conventional double panic doors, the control system comprising:

a) a base having a generally rectangular configuration, b) a bracket having a sidewall and an arm depending from said sidewall to form L-shaped configuration, c) a protruding section depending from the base having a generally U-shaped configuration, d) an engagement means to secure to said system to a conventional panic door, and e) a flexible elongate having two ends with a first end tethered to the distal end of said arm and the opposing end attached to a conventional rubber ball;

where the base and bracket are coupled and designed to be supported by and removably secured to the latching mechanisms of a conventional double panic door system.

2. The emergency entry control system according to claim 1 where the base and bracket are selectively adjustable with respect to one another to accommodate use with panic doors of varying dimensions.

3. The emergency entry control system according to claim 1 where the system can be rotatingly disengaged by force of hand or pulling said flexible elongate.

4. An emergency entry control system for conventional double panic doors, the control system comprising:

a) a base having a generally rectangular configuration,
b) a bracket having a sidewall and an arm depending from said sidewall to form L-shaped configuration,
c) a protruding section depending from the base having a generally U-shaped configuration,
d) an engagement means to secure said system to a conventional panic door,
e) a flexible elongate having two ends with a first end tethered to the distal end of said arm and the opposing end attached to a conventional rubber ball, and
f) a motorized means for rotating said system
where the base and bracket are coupled and designed to be supported by the latching mechanisms of a conventional double panic door system and mechanically removed therefrom.

5. The emergency entry control system according to claim 4 where the engagement means concurrently rotates said base and said bracket.

6. An emergency entry prevention system for conventional double panic doors, the control system comprising:
a) a base having a generally rectangular configuration,
b) a bracket having a sidewall and an arm depending from said sidewall to form L-shaped configuration,
c) a protruding section depending from the base having a generally U-shaped configuration,
d) an engagement means to secure to said system to a conventional panic door, and
e) an internal motion/vibration sensor,
f) a wireless communication system,
g) a programmable controller,
h) an audible alert system,
i) a visual alert system,
j) a global positing system,
k) a power source,
l) graphical user interface,
m) a control panel,
and arranged in a unitary component designed to be supported by and removably secured to the respective latching mechanisms of a conventional double panic door system.

7. The emergency entry control system according to claim 6 where the system comprises a motorized means for rotating said system.

8. The emergency entry control system according to claim 6 where the power source comprises rechargeable batteries.

9. The emergency entry control system according to claim 6 where the wireless communication system comprises BLUETOOTH® technology.

10. The emergency entry control system according to claim 6 where the programmable controller can determine when to engage audible and visual alerts and when wirelessly communicate with police in the event of an emergency.

11. The emergency entry control system according to claim 6 where the central component contains a dispensable canister of tear gas or the like to be disseminated in the event the programmable controller deems there is an attempt at unauthorized entry.

* * * * *